US005263897A

United States Patent [19]

Kondo et al.

[11] Patent Number: 5,263,897

[45] Date of Patent: Nov. 23, 1993

[54] FLUID SUCTION NOZZLE AND FLUID-TREATING APPARATUS

[75] Inventors: Fumio Kondo; Toshihiko Yamanaka, both of Nagoya; Tetsuo Yoshida, Hiroshima; Noritaka Hasegawa, Nagoya, all of Japan

[73] Assignees: Mitsubishi Jukogyo Kabushiki Kaisha, Tokyo; Churyo Engineering Kabushiki Kaisha, Aichi, both of Japan

[21] Appl. No.: 876,462

[22] Filed: Apr. 30, 1992

[30] Foreign Application Priority Data

Apr. 30, 1991 [JP] Japan ..... 3-124562

[51] Int. Cl.[5] ..... F24F 3/16

[52] U.S. Cl. ..... 454/189; 454/66; 454/190

[58] Field of Search ..... 454/49, 63, 65, 66, 454/67, 188, 189, 190, 191

[56] References Cited

FOREIGN PATENT DOCUMENTS

| | | | |
|---|---|---|---|
| 0413406 | 2/1991 | European Pat. Off. . | |
| 2163927 | 7/1973 | France . | |
| 147647 | 11/1979 | Japan | 454/66 |
| 271050 | 11/1988 | Japan | 454/67 |
| 1-179841 | 7/1989 | Japan . | |
| 75433 | 3/1991 | Japan | 454/188 |
| 154511 | 2/1990 | U.S.S.R. | 454/66 |
| 1592661 | 9/1990 | U.S.S.R. | 454/67 |
| 2029567 | 3/1980 | United Kingdom | 454/66 |
| 91/05210 | 4/1991 | World Int. Prop. O. . | |

*Primary Examiner*—Harold Joyce
*Attorney, Agent, or Firm*—Wenderoth, Lind & Ponack

[57] ABSTRACT

A fluid suction nozzle and a fluid-treating apparatus are used in the cleaning of air inside a local space. The suction nozzle has a suction passage and plural annular discharge passages surrounding the suction passage. The nozzle is connected with an air cleaner, etc. The air inside a local space is to be drawn in through the suction passage. At the same time, a larger amount of air is to be discharged from the discharge passages. The velocity at which fluid will flow from the outer discharge passage is smaller than that at which fluid from the same source will flow from the inner discharge passage.

10 Claims, 4 Drawing Sheets

FLUID SUCTION NOZZLE AND FLUID-TREATING APPARATUS

BACKGROUND OF THE INVENTION

1. Field of the Invention

The present invention relates to a fluid suction nozzle adapted to form a local space surrounded by an air curtain and also to a fluid-treating apparatus adapted to clean, condition, or otherwise treat the air inside the local space.

2. Description of the Related Art

The present applicant has already filed Japanese Patent Application Serial No. 169893/1990 for "Fluid Suction Nozzle and Fluid-Treating Apparatus". Such an apparatus is shown in FIG. 8, wherein a suction nozzle, indicated by numeral 1, is connected with an air cleaner 3 via a duct 2. The nozzle 1 comprises an inner member 4 and an outer member 5 that is slightly spaced from the inner member 4.

When a fan 6 incorporated in the air cleaner 3 is driven, the air discharged from the fan passes through an outer passage 7 formed inside the duct 2. The air then passes through an annular discharge passage 8 formed between the inner member 4 and the outer member 5 of the nozzle 1, and is forced obliquely downwardly into a room 9. A local space 10 is surrounded by this air flow, indicated by AC. The air occupying the space 19 is drawn into a suction passage 11 formed inside the inner member 4 of the nozzle 1. Then, the air passes through an inner fluid passage 12 formed int he duct 2 and enters the air cleaner 3, where the air flows downwardly through a filter 13, dust collecting material 14, and a deodorant 15. In this process, the air is cleaned. The air is again drawn into the fan 6. Subsequently, the process described thus far is repeated.

In the above-described apparatus, the ratio $\psi$ of the flow rate of air $Q_S$ drawn into the suction passage 11 to the flow rate of air $Q_D$ discharged from the discharge passage 8 is set greater than 1, i.e., $\psi = Q_S/Q_D$ is greater than 1. Therefore, contaminated air around the air flow AC is caught in the air flow AC and enters the local space 10. This has set a limit on the cleaning of the air occupying the local space 10.

SUMMARY OF THE INVENTION

It is an object of the present invention to provide a fluid suction nozzle and a fluid-treating apparatus which are free of the foregoing problems.

A fluid suction nozzle according to the invention comprises a suction passage through which fluid is to be drawn and two or more superposed annular discharge passages defined radially outwardly of and surrounding the suction passage so as to surround it. Fluid is discharged through the discharge passages. The fluid drawn toward the suction passage is sheathed in a film of the fluid discharged from the discharge passages. This nozzle is intended to discharge the fluid from the discharge passages at a rate greater than the rate at which the fluid will be drawn into the suction passage and is characterized in that the velocities at which fluid will flow from the discharge passages successively decrease as taken from the innermost discharge passage toward the outermost discharge passage.

The fluid suction nozzle may be integrated with a fluid-treating device for treating the fluid drawn into the nozzle.

Alternatively, the fluid suction nozzle may be connected to a fluid-treating device via a duct.

A fluid-treating apparatus according to the invention comprises: a partition member; a first fan mounted on one side of the partition member; a first fluid passage defining a first suction port communicating with the suction side of the first fan and a first discharge port formed around the first suction port and communicating with the discharge side of the first fan, the first fluid passage extending from the first suction port to the first discharge port through the first fan; a second fan mounted on the other side of the partition member; a second fluid passage defining a second suction port communicating with the suction side of the second fan and a second discharge port formed around the first discharge port and communicating with the discharge side of the second fan, the second fluid passage extending from the second suction port to the second discharge port through the second fan; and a fluid-treating device mounted in the first or second fluid passage.

The fluid-treating device may be a filter for cleaning air.

Alternatively, the fluid-treating device may be a heat exchanger.

In accordance with the present invention, the thickness of the film of the fluid discharged from the discharge passages is increased compared to the prior art. In addition, the difference of velocity between this discharged fluid and the fluid outside the local space is small. Hence, a mixing of the discharged fluid and the fluid outside the local space is suppressed.

Other objects and features of the invention will appear in the course of the description thereof which follows.

DETAILED DESCRIPTION OF THE INVENTION

Figure 1A:
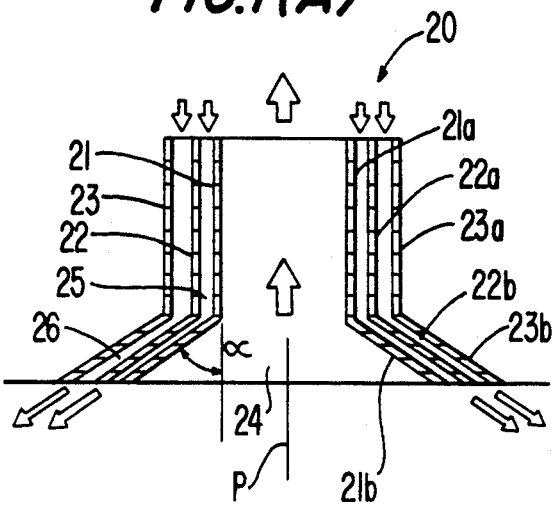
FIG. 1(A) is a cross-sectional view taken along line 1A—1A of FIG. 1(B)
Figure 1B:
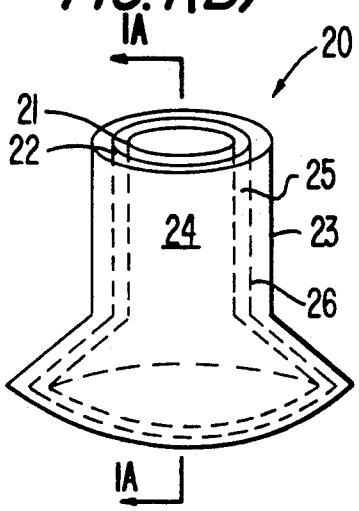
FIG. 1(B) is a perspective view of a fluid suction nozzle according to the invention.

Referring to FIG. 1, there is shown a fluid suction nozzle embodying the present invention. The nozzle, generally indicated by reference numeral 20, comprises an inner member 21, an intermediate member 22, and an outer member 23. The inner member 21 consists of a cylindrical portion 21*a* and a conical portion 21*b* which is connected with the front end of the cylindrical portion 21*a* and spreads outwardly. Similarly, the intermediate member 22 consists of a cylindrical portion 22*a* and a conical portion 22*b*. The outer member 23 consists of a cylindrical portion 23*a* and a conical portion 23*b*.

These members 21, 22, and 23 are slightly spaced from each other and are disposed coaxially. Thus, a suction passage 24 for sucking in fluid is formed inside the inner member 21. A first annular discharge passage 25 for discharging fluid is defined between the inner member 21 and the intermediate member 22. A second annular discharge passage 26 for discharging fluid is formed between the intermediate member 22 and the outer member 23. The first discharge passage 25 and the second discharge passage 26 are stacked on the outside of the suction passage 24 in this order so as to surround the suction passage 24.

The conical portions 21*b*, 22*b*, and 23*b* are tilted at the same angle of $\alpha$ to the stream line P of the fluid drawn into the suction passage 24. This angle $\alpha$ is set within the range of 45° to 90°.

The flow rate $Q_S$ of fluid drawn into the suction passage 24 is set larger than the flow rate $Q_D$ of fluid discharged from the first discharge passage 25 and from the second discharge passage 26. The flow velocity inside the second discharge passage 26 is made lower than the flow velocity inside the first discharge passage 25.

Figure 2:
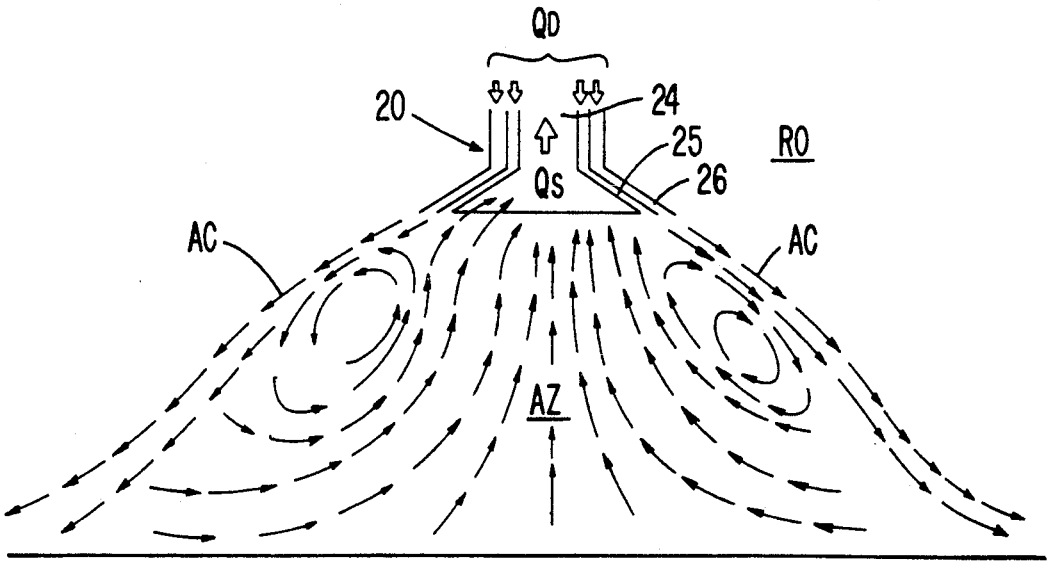
FIG. 2 is a view showing the pattern of flow created by the suction nozzle shown in FIGS. 1(A) and 1(B)

When air is blown obliquely downwardly at a given velocity from the first discharge passage 25 and from the second discharge passage 26 as shown in FIG. 2, the annular air flow AC becomes thick. A local space AZ surrounded by this air flow AC is formed inside a room or chamber RO. The air occupying the local space AZ is drawn into the suction passage 24 as indicated by the blank arrow.

Figure 3:
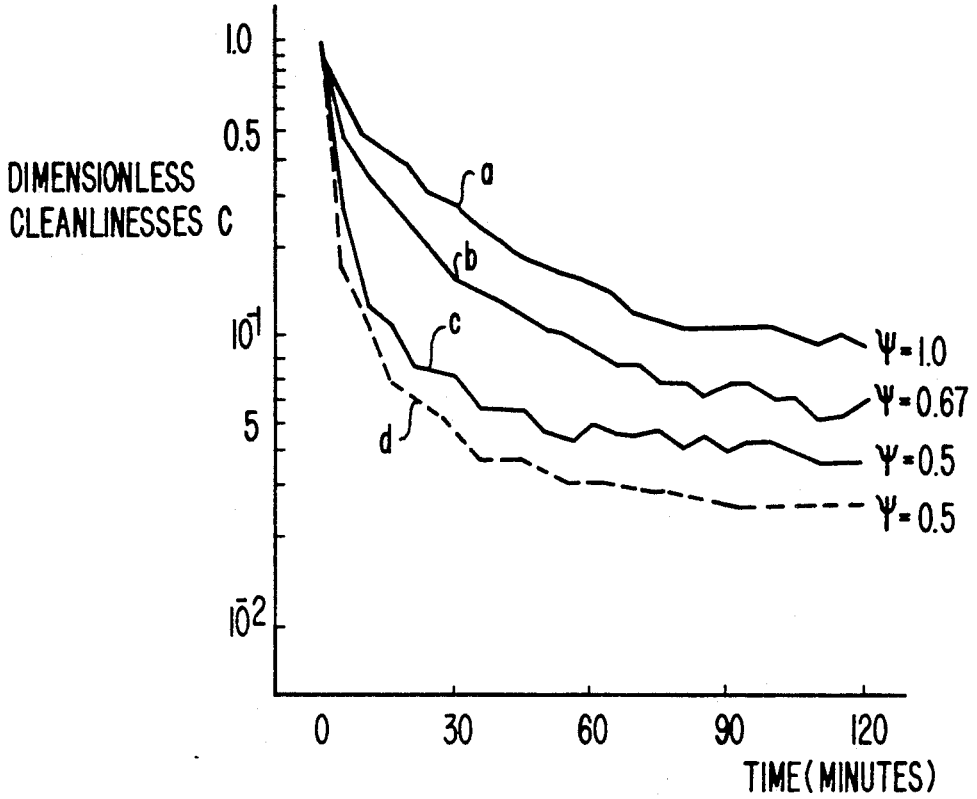
FIG. 3 is a graph in which normalized values of cleanliness inside a local space is plotted against time for the case in which the suction nozzle shown in FIGS. 1(A) and 1(B) is used and for the case in which the prior art suction nozzle shown in FIG. 8 is used.
Figure 8:
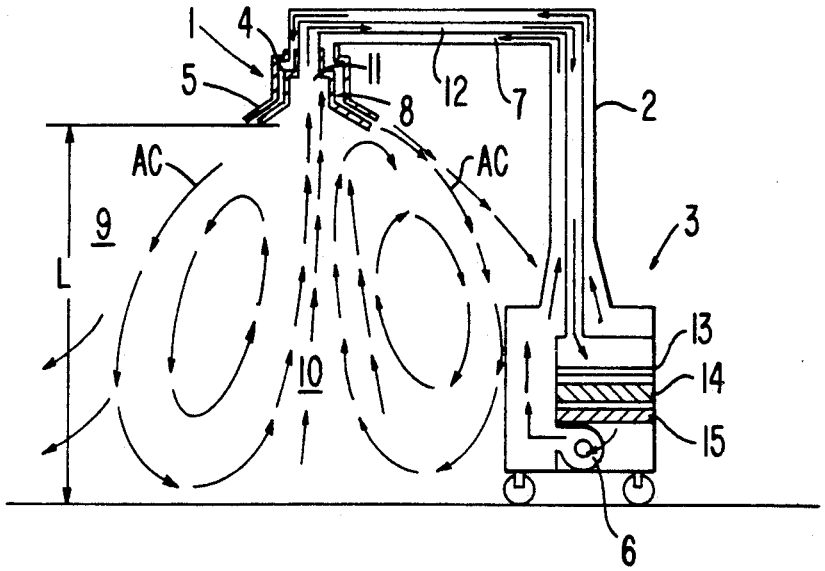
FIG. 8 (PRIOR ART)
FIG. 8 is a schematic cross-sectional view of a fluid-treating apparatus disclosed in Japanese Patent Application Serial No. 169893/1990.

FIG. 3 shows the manner in which the cleanliness C inside the local space AZ varies with time. In FIG. 3, curve a indicates the cleanliness obtained when the suction, nozzle shown in FIG. 8 is used and the ratio of flow rates $\psi$ is 1.0. Curves b, c, and d indicate cleanlinesses derived when the suction nozzle 20 according to the present invention is used. Curve b indicates the cleanliness obtained when the ratio of flow rates $\psi$ is 0.67. Curve c indicates the cleanliness obtained when the ratio of flow rates $\psi$ is 0.5. Curve d indicates the cleanliness obtained when the ratio of flow rates $\psi$ is 0.5 and the widths of the first and second discharge passages 25, 26 are doubled compared with the cases of curves b and c.

As can be seen from FIG. 3, the cleanliness C obtained when the novel suction nozzle 20 is used as indicated by curves b, c, and d is much better than the cleanliness C obtained when the suction nozzle shown in FIG. 8 is employed as indicated by curve a. Where the novel suction nozzle is used, as the ratio of flow rates $\psi$ is reduced, the cleanliness C is improved. This is explained as follows. Contaminants diffuse due to a mixing of the air, at a rate that flow AC and the surrounding air increases in proportion to the velocity gradient of the air flow, AC, and this diffusion is suppressed with increases in the thickness of the film of the air flow AC. Therefore, reductions in the velocity of air flowing from the outer discharge passage 26 decrease the velocity gradient of the air flow AC. Also, the thickness of the air flow AC is increased.

Figure 4:
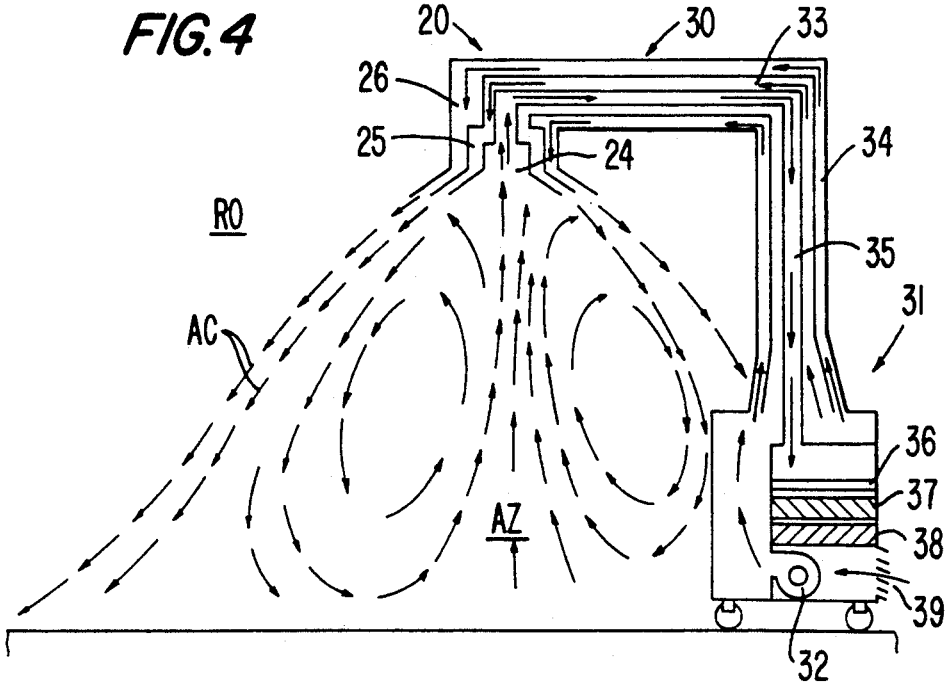
FIG. 4 is a schematic cross-sectional view of a fluid-treating apparatus according to the invention.

Referring next to FIG. 4, there is shown a fluid-treating apparatus in which the suction nozzle 20 described above is connected with an air cleaner 31 via a duct 30. When a fan 32 incorporated in the air cleaner 31 is driven, the air blown from this fan passes through outer annular fluid passages 33 and 34 formed in the duct 30 and then flows through the first discharge passage 25 and the second discharge passage 26 in the suction nozzle 20. Then, the air is blown into the room RO.

The air occupying the local space AZ surrounded by the air flow AC is drawn into the suction passage 24 of the suction nozzle 20, passes through a passage 35 formed in the center of the duct 30, and enters the air cleaner 31. The air then flows downwardly through a filter 36, dust collecting material 37, and a deodorant 38. In this process, the air is cleaned. The air is again drawn in by the fan 6 together with the air drawn into the cleaner 31 from a suction port 39. The process described thus far is repeated.

Figure 5:
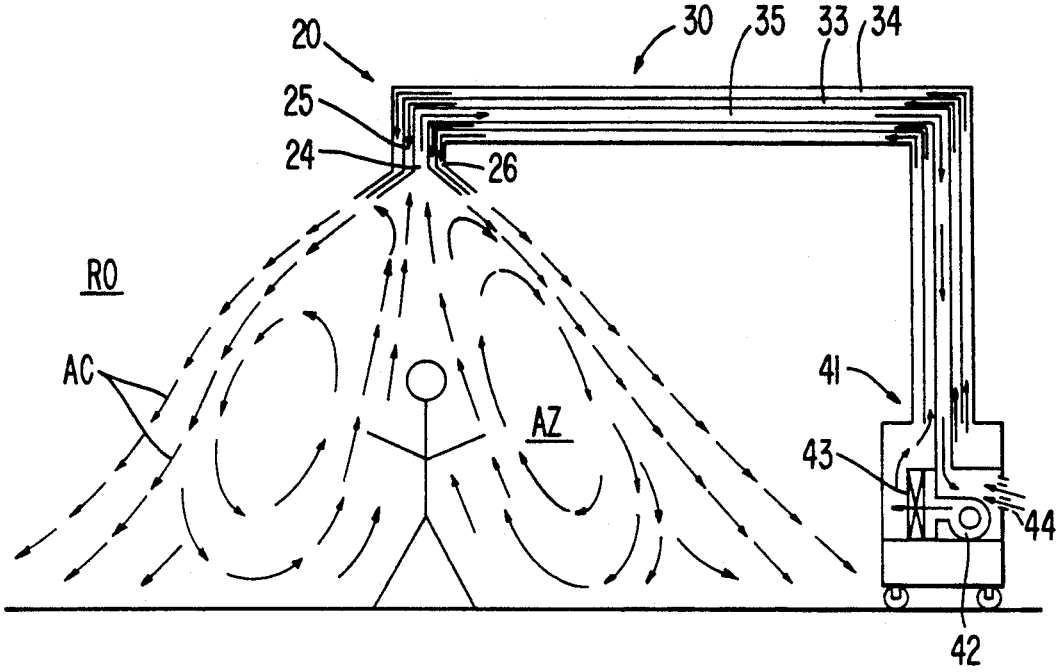
FIG. 5 is a schematic cross-sectional view of another fluid-treating apparatus according to the invention.

Referring to FIG. 5, there is shown a fluid-treating apparatus in which the suction nozzle 20 described above is connected with an air conditioner 41 via the duct 30. When a fan 42 mounted within the air conditioner 41 is driven, the air discharged from the fan passes through a heat exchanger 43. In this process, the air is heated or cooled so as to be conditioned. The conditioned air passes through the outer annular passages 33 and 34 inside the duct 30, flows through the first discharge passage 25 and the second discharge passage 26 in the suction nozzle 20, and passes into the room RO. The air occupying the local space AZ surrounded by the air flow AC is drawn into the suction passage 24 of the nozzle 20 and enters the air conditioner 41 through the central passage 35 in the duct 30. The air is then again drawn in by the fan 42 with the air drawn into the conditioner 41 from a suction port 44. The process described thus far is repeated.

Figure 6:
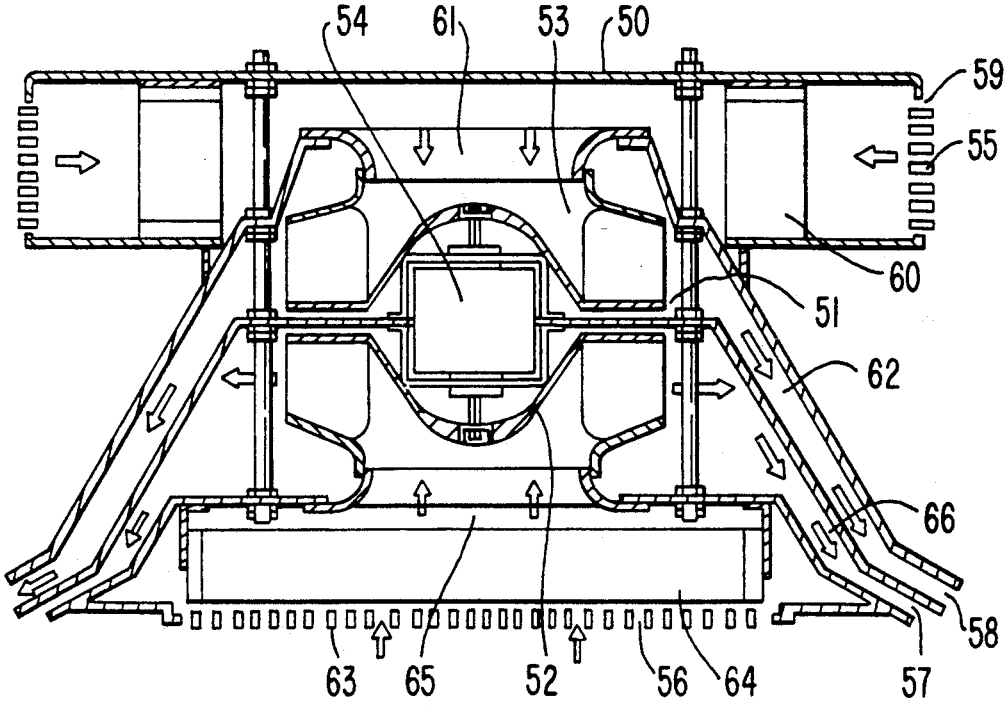
FIG. 6 is a longitudinal cross-sectional view of a further fluid-treating apparatus according to the invention.

Referring to FIG. 6, there is shown a fluid-treating apparatus in which a suction nozzle is integral with a fluid-treating device. The inside of a casing 50 is partitioned into an upper portion and a lower portion by a partition member 51. A first centrifugal fan 52 is mounted below the partition member 51. A second centrifugal fan 53 is disposed above the partition member 51. These fans 52 and 53 are rotated by an electric motor 54 fixed to the partition member 51.

A second suction port 55 is formed in the outer periphery of the casing 50 near the top of the casing. A first suction port 56 is formed in the center of the lower portion of the casing 50. An annular first discharge port 57 is formed around the first suction port 56. A second discharge port 58 is formed outside, and adjacent to, the first discharge port 57.

The first suction port 56 is in communication with the suction side of the first centrifugal fan 52 via both a HEPA (high efficiency particulate air) filter 64 and a bell-mouth 65. The first discharge port 57 is in communication with the discharge side of the first centrifugal fan 52. Thus, a first fluid passage 66 which extends from the first suction port 56 to the first discharge port 57 via the first centrifugal fan 52 is formed.

The second suction port 55 is in communication with the discharge side of the second centrifugal fan 53 via a HEPA filter 60 and a bell-mouth 61. The second discharge port 58 is in communication with the discharge side of the second centrifugal fan 53. In this way, a second fluid passage 62 is formed which extends from the second suction port 55 to the second discharge port 58 via the second fan 53.

When the centrifugal fans 52 and 53 are driven by the motor 54, the air inside the room is forced into the casing 50 from the second suction port 55 via a suction grille 59. The air then flows through the HEPA filter 60, so that the dust entrained by the air is removed. Subsequently, the air is drawn in by the second centrifugal fan 53 while guided by the bell-mouth 61. The air blown by the fan 52 passes through the second fluid passage 62 and is blown into the room from the second discharge port 58. At the same time, the air inside the local space AZ passes from the first suction port 56 into the casing 50 via a suction grille 63. The air then flows through the HEPA filter 64, whereby the dust entrained by the air is eliminated. The air is thereafter drawn in by the first centrifugal fan 52 while guided by the bell-mouth 65. The air blown by the fan 52 passes through the first fluid passage 66 and is blown out from the first discharge port 57.

Figure 7:
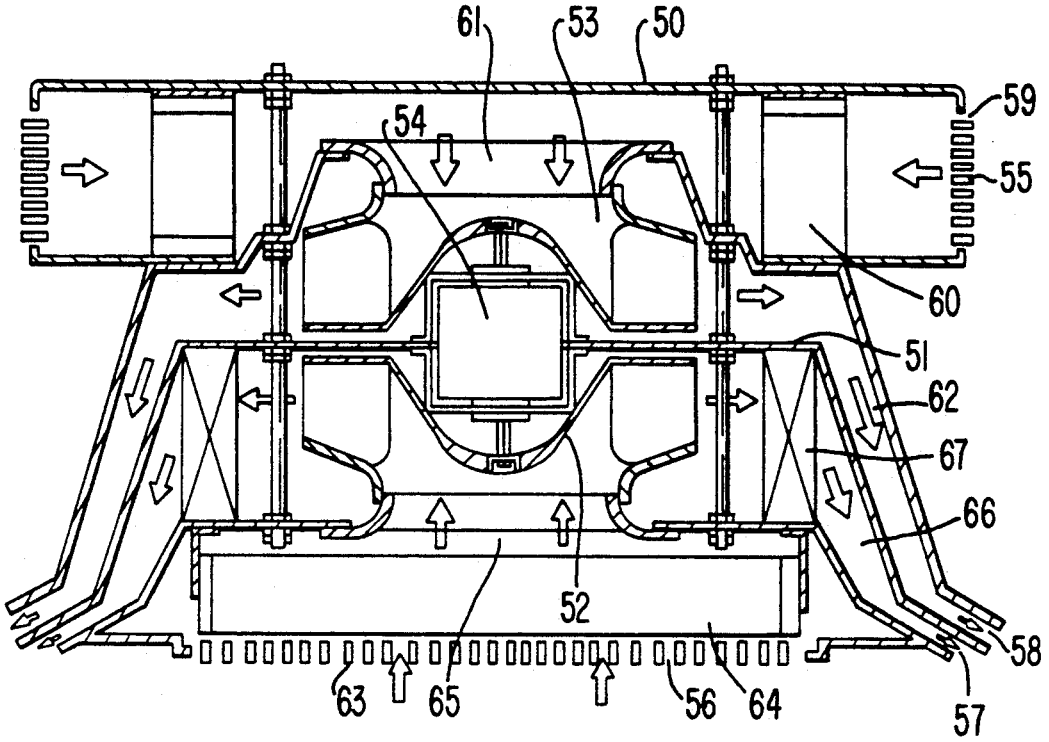
FIG. 7 is a longitudinal cross-sectional view of a yet another fluid-treating apparatus according to the invention.

Referring to FIG. 7, there is shown another fluid-treating apparatus. This is similar to the fluid-treating apparatus shown in FIG. 6 except that a heat exchanger 67 is mounted in the first fluid passage at the discharge side of the first centrifugal fan 52. Air is caused to pass through the heat exchanger 67. In this manner, cooled or heated air is blown out of the first discharge port 57 to cool or warm the local space AZ.

Air has been mentioned above as being drawn in and blown out by the present invention. However, the invention is not limited in its application to air; it may be applied for use with any other gas or liquid. Also in the above embodiments, two discharge passages are shown. However, three or more discharge passages may be formed, in which case the flow velocity of the fluid becomes sequentially smaller in the discharge passageways taken toward the outermost passage. Although the suction passage has been described as having a circular cross section and the discharge passages as being circular, elliptical, polygonal, and any other desired shaped may be adopted.

In accordance with the present invention, the rate at which the fluid will be discharged from the discharge passages will be larger than the rate at which the fluid is drawn into the suction passage. Superposed discharge passages are so designed that the flow velocities of the fluid discharged therefrom decrease successively toward the outermost discharge passage. Therefore, the film of the fluid discharged from the discharge passages is thick. Furthermore, a small velocity difference exists between the discharged fluid and the fluid outside the local space. Consequently, a mixing of the discharge fluid and the fluid outside the local space is suppressed. The fluid inside the local space can be cleaned or otherwise treated by connecting this fluid suction nozzle with a fluid-treating device.

What is claimed is:

1. A fluid suction nozzle comprising: an inner tubular member defining a suction passage therewithin; an intermediate tubular member extending around and spaced from said inner tubular member; an inner discharge passage being defined between said inner and said intermediate members; an outer member extending around and spaced from said intermediate member; and outer discharge passage being defined between said outer and said intermediate tubular members; said discharge passages each having an inlet and an outlet at an inlet end and an outlet end of the nozzle; and the dimensions of the tubular members of said nozzle being such that when a common supply of fluid is fed to the inlet end of the nozzle, the fluid will discharge from the outlet of said outer discharge passage at a velocity less than that at which the fluid will discharge from the outlet of said inner discharge passage.

2. A fluid suction nozzle as claimed in claim 1, wherein each of said tubular members has a respective frustoconical portion at the outlet end of the nozzle, and each said frusto-conical portion expands outwardly as taken in an axial direction of the nozzle extending from the inlet end to the outlet end of the nozzle.

3. A fluid suction nozzle as claimed in claim 2, wherein each of said tubular members has a respective cylindrical portion at the inlet end of the nozzle.

4. A fluid treating apparatus comprising: a suction nozzle including an inner tubular member defining a suction passage therewithin, an intermediate tubular member extending around and spaced from said inner tubular member, and an outer tubular member extending around and spaced from said intermediate member, an inner discharge passage being defined between said inner tubular member and said intermediate tubular member, and an outer discharge passage being defined between said intermediate tubular member and said outer tubular member; and means for drawing fluid into said suction passage at a rate $Q_S$, for treating the drawn-in fluid, and for forcing fluid through said discharge passages at a rate $Q_D$ to form a curtain of fluid around a space in front of said suction passage, wherein the ratio of said rates $Q_D/Q_S$ is greater than 1, and wherein the velocity at which fluid is discharged from said outer discharge passage is less than the velocity at which fluid is discharged from said inner discharge passage.

5. A fluid treating apparatus as claimed in claim 4, wherein said means comprises a casing having a suction portion open to the exterior, a duct extending between said casing and said suction nozzle, the duct including a partition dividing the interior of the duct into separated passageways leading to said suction passage and to said discharge passageways, respectively, and a fan disposed within said casing, the fan having an intake communicating with said suction port of the casing and the passageway of the duct leading to said suction passage of the nozzle, and the fan having an outlet communicating with the passageway of the duct leading to said discharge passages of the nozzle.

6. A fluid treating apparatus as claimed in claim 5, wherein each of said tubular members has a respective frustoconical portion at the outlet end of the nozzle, and each said frustoconical portion expands outwardly as taken in an axial direction of the nozzle extending from the inlet end to the outlet end of the nozzle.

7. A fluid treating apparatus as claimed in claim 6, wherein each of said tubular members has a respective cylindrical portion at the inlet end of the nozzle.

8. A fluid treating apparatus as claimed in claim 4, wherein said means comprises a casing having a suction port open to the exterior, a partition dividing the casing into first and second portions, the first suction port being open to the interior of the first portion of said casing via said suction passage, the second suction port being open to the interior of the second portion of said casing, said inner discharge passage being open to the interior of the first portion of said casing, said outer discharge passage being open to the interior of the second portion of the casing, a first fan disposed in the first portion of said casing and having an intake disposed toward said first suction port and an outlet disposed toward said inner discharge passage, and a second fan disposed in the second portion of said casing and having an intake disposed toward said second suction port and an outlet disposed toward said outer discharge passage.

9. A fluid treating apparatus as claimed in claim 8, wherein said means comprises an air filter.

10. A fluid treating apparatus as claimed in claim 8, wherein said means comprises a heat-exchanger.

* * * * *